US005842619A

United States Patent [19]

Cousino

[11] Patent Number: 5,842,619

[45] Date of Patent: Dec. 1, 1998

[54] DEVICE FOR CONTROLLING THE DISCHARGE OF HEAVY MATERIAL FROM A CONTAINER

[76] Inventor: Scott J. Cousino, 4949 Appaloosa Trail, Norcross, Ga. 30071

[21] Appl. No.: 791,188

[22] Filed: Jan. 31, 1997

[51] Int. Cl.[6] ..... B65G 65/62

[52] U.S. Cl. ..... 222/505; 222/185.1; 251/248; 251/300

[58] Field of Search ..... 222/505, 185.1, 222/556, 558; 251/248, 300, 279

[56] References Cited

U.S. PATENT DOCUMENTS

| | | | |
|---|---|---|---|
| 802,357 | 11/1905 | Lawson . | |
| 938,954 | 11/1909 | Bittrich | 222/558 |
| 1,219,737 | 3/1917 | Heilig . | |
| 1,667,959 | 5/1928 | Talbot . | |
| 1,692,374 | 11/1928 | Jaeger . | |
| 1,756,552 | 4/1930 | Heitz | 251/248 |
| 2,794,575 | 6/1957 | Hall | 222/165 |
| 2,827,204 | 3/1958 | McCurdy | 222/176 |
| 3,022,921 | 2/1962 | Davenport et al. | 222/108 |
| 4,023,719 | 5/1977 | Noyon | 222/505 |
| 4,082,247 | 4/1978 | Dalton | 251/248 |
| 4,200,208 | 4/1980 | Hassenauer | 222/505 |
| 5,114,040 | 5/1992 | Brenish et al. | 222/1 |
| 5,199,612 | 4/1993 | Raque | 222/134 |

OTHER PUBLICATIONS

Catalog 191, Shaw Equipment Co., Inc., p. 82, printed before Dec. 1996.

Catalog #1, M.D. Moody & Sons, Inc., pp. 98–99, printed before Dec. 1996.

Catalog #2, M.D. Moody & Sons, Inc., pp. 116–117, printed before Dec. 1996.

*Primary Examiner*—Steven O. Douglas
*Attorney, Agent, or Firm*—Troutman Sanders LLP; Gerald R. Boss, Esq.; Roger S. Williams

[57] ABSTRACT

A device is provided for controlling a discharge of a heavy material from a container such as a bucket, hopper or bin. The device generally includes a combination of gears and levers to couple rotation of a hand wheel or other bar to motion of the release door of a container such that the gears provide a force to the release door which is much greater than that applied to the hand wheel or bar. More specifically, the device may consist of a hand-driven shaft capable of being rotated by a hand wheel or other device. The rotation of this shaft may be coupled by interlocking gears to the rotation of a drive shaft, which is attached to the release door of the container by a lever, such that rotation of the drive shaft causes the release door to open or close, regulating the discharge of concrete or other heavy material from the container.

3 Claims, 3 Drawing Sheets

DEVICE FOR CONTROLLING THE DISCHARGE OF HEAVY MATERIAL FROM A CONTAINER

BACKGROUND OF THE INVENTION

1. Technical Field

This invention relates generally to a device for controlling the release door on a container. Particularly, this invention relates to a device for opening and closing a release door to control the discharge of concrete or other heavy material from a container.

2. Description of the Prior Art

Concrete is one of the most commonly used materials in the construction of walls, floors, supports and slabs in modern residential, commercial and industrial buildings, as well as roads. Generally, concrete is used to form these structures by filling appropriately shaped forms or molds and allowing the concrete to harden into the desired structure. One common method of delivery of concrete to the forms or molds is through use of a large bucket suspended from a crane. Concrete is discharged from the bottom of the bucket through a gate or valve, which can be controlled either through use of a power operated device or by hand.

In the past, several methods have been developed to control the discharge of concrete from delivery buckets. Almost invariably these methods have used one or more valves or gates to control the discharge of concrete (or other substances), most commonly using either a clam shell valve, a sliding planar gate or a sliding cylindrical gate. These valves or gates are commonly actuated either by levers, by a combination of gears and tracks or by means of a pneumatic or hydraulic device. However, each of these types of discharge control devices has shortcomings.

One of the most common types of discharge control devices for concrete buckets consists of a spring loaded clam shell valve which is actuated by a hand lever. Due to the spring driven opening and closing of this type of valve, the valve can be maintained only fully open or fully closed, not in intermediate positions. This type of device has the disadvantage of not allowing control of the rate discharge of concrete at less than maximal rates, making it difficult to discharge precise amounts of concrete into the form or mold being used.

Several devices have been developed which do allow control of the discharge of containers at less than maximal rates. These have generally used either planar or cylindrical sliding gate valves which can be partially opened, allowing a less than full flow discharge of the concrete. Unlike the spring loaded valves, the force used to open or close these gates must be either provided by hand or by a power device.

One type of these sliding gate valve devices uses hand driven levers to control the opening and closing of the discharge gate. Examples of this type of discharge control device are typified by the inventions of Talbot et. al. (U.S. Pat. No. 1,667,659) and Noyon (U.S. Pat. No. 4,023,719). In general, the control levers must be relatively long to provide adequate force to open or close the gate under pressure or flow of a heavy and granular substance such as concrete. As a result, these levers require a relatively large amount of space to swing from the open to closed position, and are somewhat difficult to operate. Additionally, to provide a partial flow, the levers must be held in an intermediate position by the operator, which may often be a tiring and stressful endeavor.

Another type of device which could be used to allow controlled discharge of concrete from a concrete bucket uses a hand rotatable wheel or U-shaped handle to rotate a shaft, and thereby a gear which is used to move the discharge gate along a second linear track-like gear. Examples of this type of control device include the inventions of McCurdy (U.S. Pat. No. 2,827,204) and Davenport et. al. (U.S. Pat. No. 3,022,921). The invention of Heilig (U.S. Pat. No. 1,219,737) is a variation of this type of means in that it possesses two shafts, the rotation of which are coupled via gears to each other and to movement of the gate along a linear track-like gear. These devices have the disadvantage of allowing only a planar discharge gate, and can be somewhat difficult to operate under the load of a heavy and granular substance such as concrete. Due to the relatively large number of gears and tracks required for this type of device, it is also somewhat complex to construct and maintain in working condition.

Another hand-operated device which could be used to operate a discharge door at the outlet of a concrete bucket is represented by the invention of Lawson (U.S. Pat. No. 802,357). This device uses a U-shaped shaft and gears to couple rotation of a U-shaped crank to movement of a pivoting cylindrical discharge gate. In respect to operation of a concrete bucket, this device has the disadvantage that the U-shaped shaft must be located at the pivot of the gate. Therefore, since the crank is limited to being located within the radius of the gears from the axis of the U-shaped crank, the control device must be located near the bottom of the bucket in a location which may not be easily accessible to the operator.

Yet another device used to control discharge of concrete from a concrete bucket uses a pneumatic or hydraulic device to move the discharge release door. Examples of the type of discharge control device include the inventions of Hassenauer (U.S. Pat. No. 4,200,208) and Raque (U.S. Pat. No. 5,199,612). This type of device has the advantage of providing a large amount of force to produce movement of the release door even under the load of a heavy granular material such as concrete. However, this type of device is much more complex than the previously described devices, and is thus much more expensive to produce and more likely to break down. In addition, a power source of pressurized liquid or air must be provided to operate the device, requiring the addition of either bulky equipment or supply lines which can potentially interfere with movement and placement of the bucket.

SUMMARY OF THE INVENTION

The present invention recognizes and addresses the above-discussed shortcomings and disadvantages, as well as others, of prior devices used to control the release of concrete and other heavy materials from a container. In accordance with the teachings of the present invention, a novel discharge gate device is provided.

Generally, the invention relates to a device using a combination of gears and levers to couple rotation of a hand wheel to easily control the motion of the release door of a concrete bucket or related container. Further, the device may include gears adapted such that the force provided to the release door is much greater than that applied to the hand wheel.

More specifically, the invention consists of a hand-driven shaft which may be rotated by a hand-rotatable wheel or bar. The rotation of this shaft is coupled by interlocking gears to the rotation of a drive shaft, with a gear ratio appropriate to increase the force applied by the drive shaft. The drive shaft is attached to the release door of the container by a bar or lever, such that rotation of the drive shaft causes the release door to open or close, regulating the discharge of concrete or other heavy material from the container.

The hand-driven and drive shafts may be arranged in virtually any configuration, as long as the gears interlock in a manner coupling rotation of the shafts. The gears may also be of many shapes, including circular or partial arcuate configurations, as long as the teeth of the gears interlock in a manner allowing the rotation of the shafts to be coupled throughout a range of motion sufficient to open and close the release door.

In the preferred embodiment, the hand-driven and drive shafts are arranged parallel to one another, and can be placed relatively close together to occupy a minimum of usable space. The gear affixed to the hand-driven shaft is arranged in a circular manner about the hand-driven shaft and the gear affixed to the drive shaft is a circular gear arranged to rotate about the drive shaft. The gear ratio between the hand-driven shaft gear and the drive shaft gear is preferably at least 3:1 to provide an optimal amount of force in moving the release door in response to the hand driven rotation of the hand driven shaft under the load of a heavy granular substance, such as concrete.

The device may include a cylindrical swinging release door affixed at the bottom of the container. This release door may be attached by a rotatable means of attachment to the body of the container such that it smoothly swings along a path defined by a correspondingly cylindrical shaped surface of the release door assembly at the bottom of the container. This rotatable means of attachment may take the form of a variety of devices, such as a pin or bolt, about which the door may rotate.

The device may also include a bar or lever to translate the force of rotation of the hand-driven shaft to the release door, allowing location of the control wheel in a position more convenient to access for the container operator (e.g., above the bottom of the container). This bar or lever may be attached to the release door and the drive shaft via rotatable attachments. For example, the lever may be attached to the drive shaft via a freely rotatable pin or bolt joining the shaft to an arm rigidly affixed to the drive shaft. A similar connection could serve to attach the lever to the release door, allowing the door to swing about its pivot while maintaining attachment to the lever.

The device may also include a means for locking the position of the hand wheel and thus the release door, such that an intermediate rate of discharge may be maintained without necessitating the constant attention of the operator. For example, a locking nut arrangement may be included on the shaft of the hand wheel, which may be easily tightened to lock the wheel in position.

The aforementioned and other aspects of the present invention are described in the detailed description and attached illustrations which follow.

DETAILED DESCRIPTION OF PREFERRED EMBODIMENT

Figure 1:
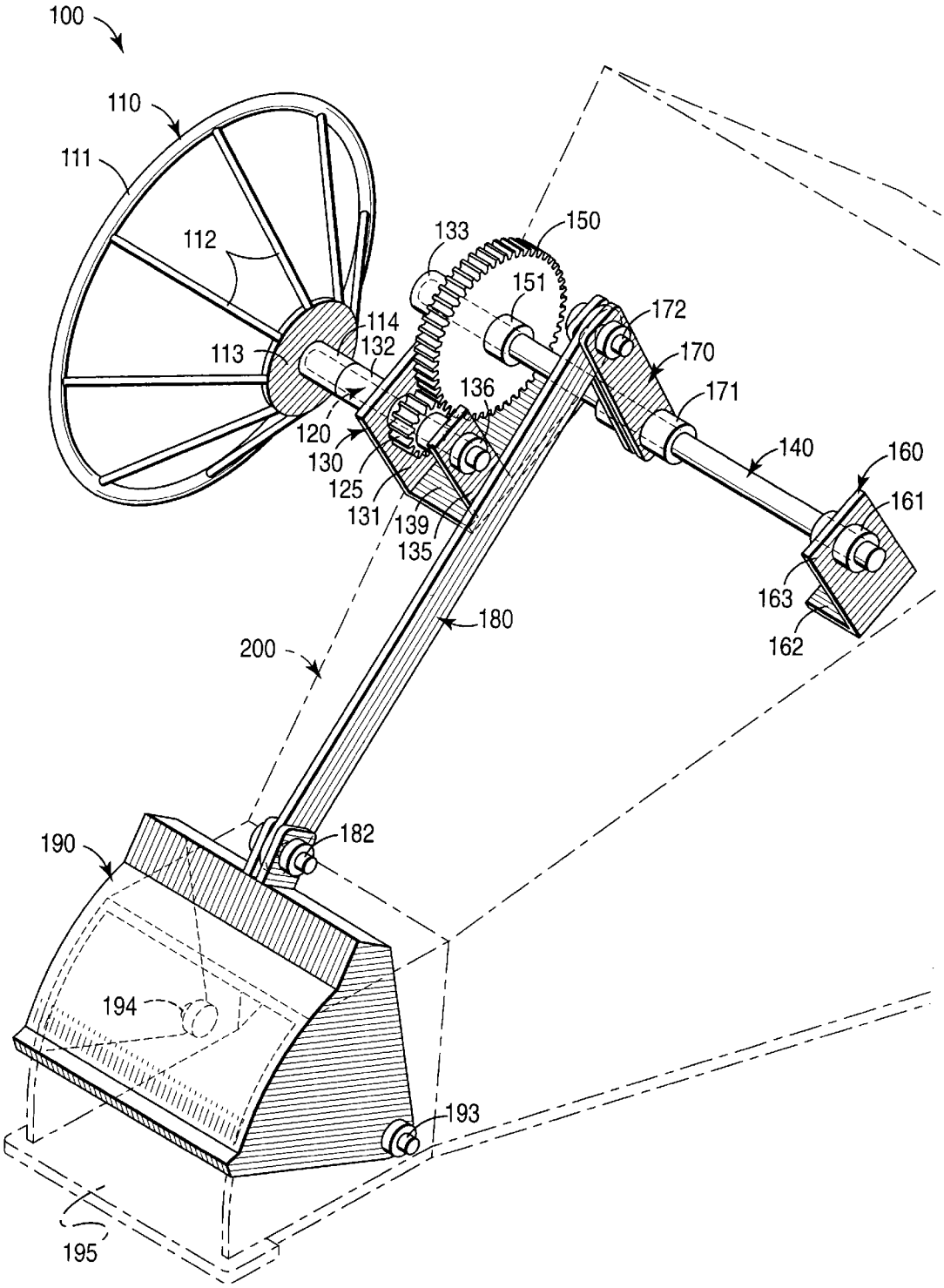
FIG. 1 is a perspective view of the device for controlling the discharge of heavy material from a container in a partially open position.

Referring now to the figures in which like reference numerals indicate like or corresponding features, FIG. 1 shows the preferred embodiment of the device 100 for controlling the discharge of material from a container 200. Preferably, the device consists of a plurality of mechanical components, including several shafts and gears, and at least one bar or lever. Unless otherwise noted, these components are preferably made of a high-strength steel, but may also be made of some other suitable high-strength material.

In the preferred embodiment, the hand-driven and drive shaft mountings 130, 160 are welded or bolted or otherwise affixed to the exterior of the container 200 as indicated in FIG. 1. The drive shaft single mounting 160 consists of ½ inch thick rectangular steel plate 163 with a height of 8 inches and a width of 4 inches, with a hole sized to accept the drive shaft 140. A boss 161 consisting of a 3 inch long, ½ inch thick tube affixed to the drive shaft 140 via a set screw in order to prevent the shaft from sliding. The drive shaft mounting 160 is welded or otherwise affixed to a 4 inch by 4 inch base plate 162 which is in turn bolted or welded to the container body.

As shown in FIG. 1, the dual shaft mounting 130 consists of a larger mounting plate 131 supporting both the hand-driven shaft 120 and the drive shaft 140, a smaller mounting plate 135 supporting only hand-driven shaft 120, and a base plate 139 to which the mounting plates are welded or otherwise affixed. The larger mounting plate 131 consists of a ½ inch thick rectangular steel plate with a height of 8 inches and a width of 12 inches, with holes sized to accept the hand-driven 120 and drive shaft 140 as shown. Each of these shafts 120 & 140 are secured to the mounting plate 131 via a boss 132 & 133 respectively consisting of a 3 inch long, ½ inch thick tube affixed to the appropriate shaft 120 & 140 via a set screw in order to prevent shaft sliding.

The smaller mounting plate 135 consists of a ½ inch thick rectangular steel plate with a height of 8 inches and a width of 4 inches, with a hole sized to accept the hand-driven shaft 120 as shown. The hand-driven shaft is secured to the mounting by a second boss 136 consisting of a 2 inch long, ½ inch thick tube affixed to the hand-driven shaft 140 via a set screw in order to prevent shaft sliding. The base plate 139 consists of a ½ inch thick rectangular steel plate with a width of 8 inches and a length of 12 inches. The mounting plates are welded, bolted or otherwise affixed to the base plate 139 in positions appropriate to support the shafts in a parallel configuration.

Also as seen in FIG. 1, in the preferred embodiment, the hand-driven shaft 120 is constructed of high-strength steel, and has a diameter of 1 3/16 inches and a length of 14 inches. The end to which the gear is affixed contains a ¼ inch key way extending 5½ inches into the shaft along its edge. An oversized washer is affixed at this end as well. The hand wheel 110 may be bolted or otherwise affixed onto the shaft.

As shown in FIG. 1, the hand wheel 110 is constructed of high strength steel and consists of a 1 inch diameter round pipe 111 formed into a circle with a diameter of 25½ inches, attached by ½ inch spokes 112 to a 7 inch diameter ½ inch thick steel disk 113. This disk is welded or otherwise attached to the hand-wheel boss 114. The hand-wheel boss 114 consists of a 2½ inch long ½ inch thick tube which is attached by two set screws to the hand-driven shaft 120, and additionally serves to prevent slippage of the shaft from the double mounting. Optionally, a locking nut could be used to secure the hand wheel in a particular position (not shown).

It should be obvious to one of ordinary skill in the art that any of a variety of similar devices could be used in place of a hand wheel to turn the hand-driven shaft, such as a bar or crank.

In the preferred embodiment the drive shaft 140 is constructed of high-strength steel, and has a diameter of 1 7/16 inches and a length of 34 inches. The end to which the gear is affixed has a ⅜ inch diameter key way located 3½ inches from the end of the shaft and extending 4 inches along the shaft for attachment of the gear. A second ⅜ inch key way located 14 inches from the gear end of the shaft extends 5 inches along the shaft for attachment of the lever arm.

As shown in FIG. 1, the hand-driven gear 125 is a circular toothed gear, constructed of high strength steel, with a diameter of 3½ inches and a thickness of 1 3/16 inches. The gear has 15 teeth with a face if 1¾ inches. The gear has an axial hole sized to allow it to fit onto the hand-driven shaft 120, and a ¼ inch key way to lock the gear in position on the shaft.

Also as shown in FIG. 1, the drive gear 150 is a circular gear, constructed of high strength steel, with a diameter of 10½ inches and a thickness of 1 3/16 inches. The gear has 50 teeth with a face of 1¾ inches. The gear contains an axial hole sized to allow it to fit onto the drive shaft 140, and two ⅜ inch key ways to lock the gear in position on the shaft. While the above described gears both operate by interaction of interlocking teeth, it should be obvious to one of ordinary skill in the art that other types of gears, such as friction gears, could be used in place of the toothed gears.

As shown in FIG. 1, a lever mechanism, composed of a lever bar 180 and an opener arm 170, connects the drive shaft 140 to the container release door 190. The opener arm 170 is constructed of high strength steel and consists of a flat bar with a length of 12 inches, a width of 3 inches and a thickness of ½ inch. The opener arm 170 has two holes, one hole adapted to fit the opener arm/drive shaft connection boss 171 for connection to the drive shaft 140, and the other hole adapted to fit the opener arm/lever bar connecting means 172 for attachment to the lever bar 180. The opener arm/drive shaft connection boss 171 is rigidly affixed to the drive shaft 140 via a key way or other device. The opener arm/lever bar is attached to the lever bar by a bolt, pin or other means 172 allowing rotation of the lever bar about the attachment.

The lever bar 180 connects the opener arm 170 to the container release door 190. The lever bar may be of sufficient length to allow placement of the drive and hand-driven shafts at the desired convenient location on the container exterior 200. The lever bar contains holes adapted to allow connection to the opener arm 170 and container release door 190, via bolts, pins or other means allowing rotation 182.

Also as shown in FIG. 1, the container release door 190 consists of a substantially cylindrical pivoting gate, attached to the container by a bolt, pin, or other means 193 & 194 allowing rotation. In the preferred embodiment, this release door is positioned to allow rotation about its point of attachment to cause the release door to slide smoothly along a complementary cylindrical surface at the outlet of the container discharge 195.

Figure 2:
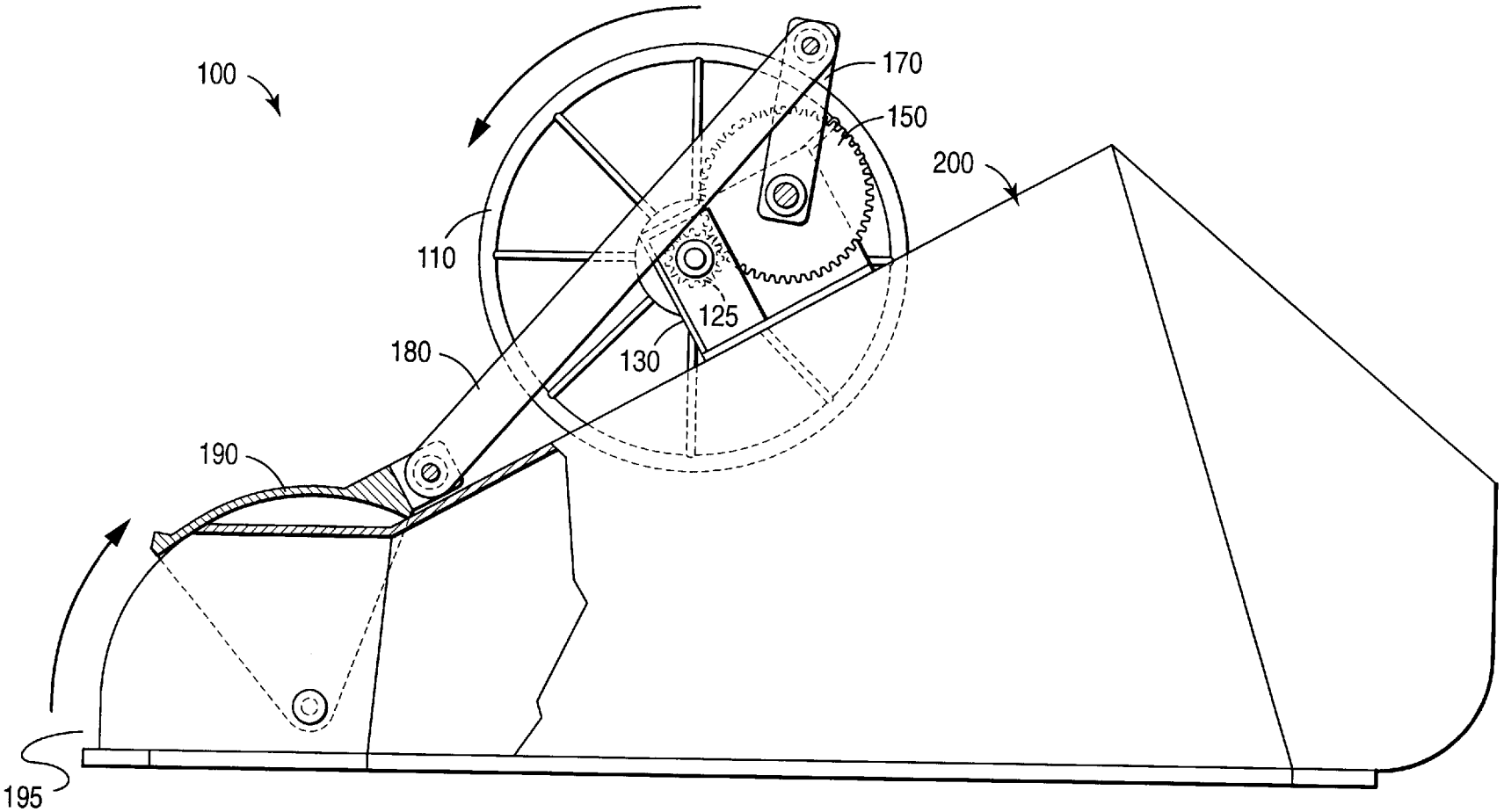
FIG. 2 is a right side view of the device for controlling the discharge of heavy material from a container in a fully open position.

FIG. 2 shows the device for controlling the discharge of heavy material from a container in a configuration such that the container release door 190 is held in the fully open position. As demonstrated by the arrows, a counter-clockwise (from this perspective) rotation of the hand wheel 110 results in opening of the release door.

The opening of the container 200 is accomplished as follows: rotation of the hand wheel 110 in a counter-clockwise direction causes simultaneous rotation of the hand-driven shaft 120 and hand-driven gear 125; rotation of the hand-driven gear 125 is coupled to rotation of the drive gear 150 and drive shaft 140 via interaction of the meshed gear teeth; rotation of the drive shaft results in rotation of the opener arm 170 upwards and the lever bar 180 away from the opening 195 in the container 200; and the lever bar 180 pulls the release door 190 such that it pivots about attachments 193 and 194 away from the opening 195 resulting in the opening of the container 200.

Figure 3:
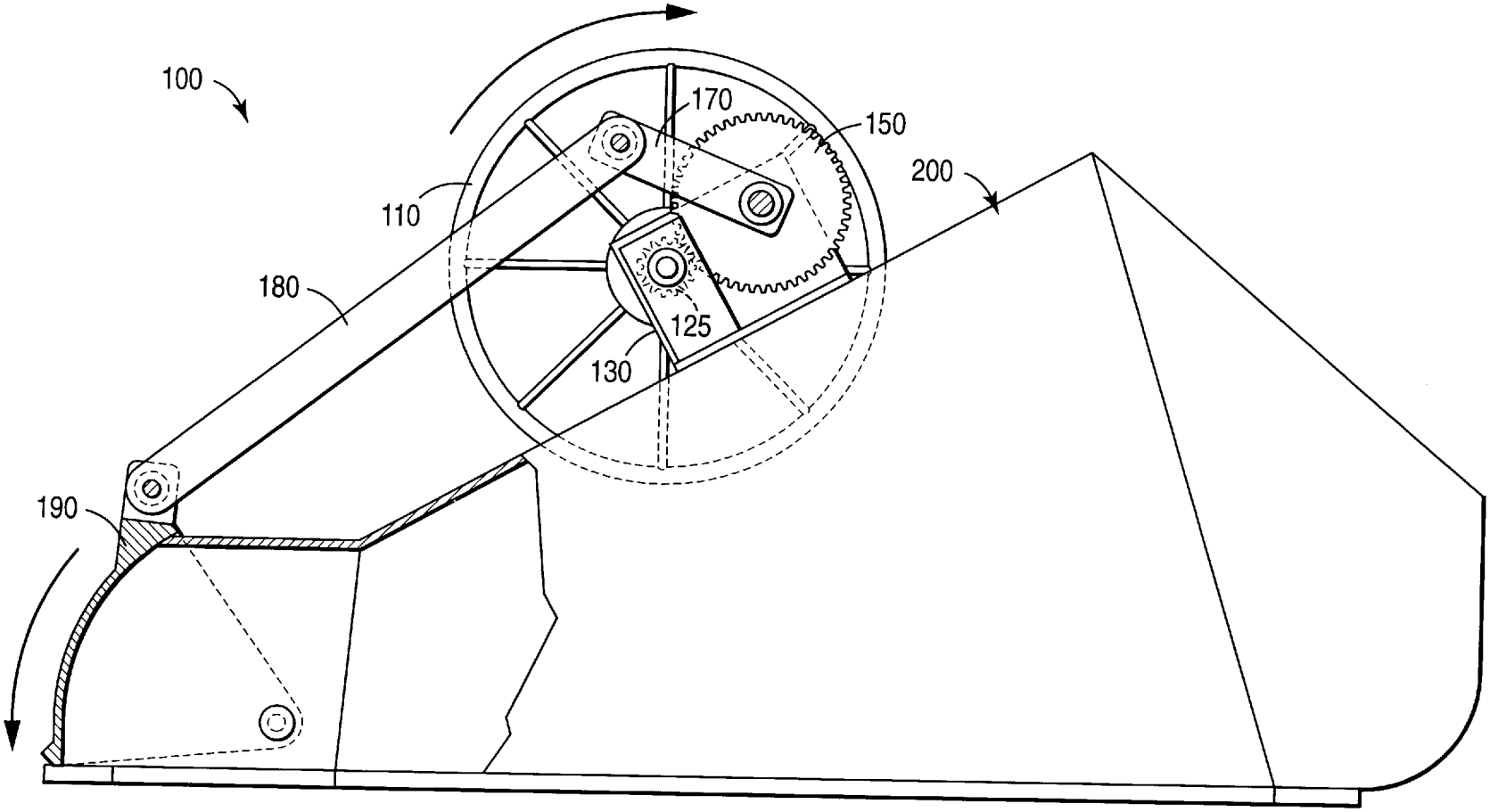
FIG. 3 is a right side view of the device for controlling the discharge of heavy material from a container in a fully closed position.

FIG. 3 shows the device for controlling the discharge of heavy material from a container in a configuration such that the container release door 190 is held in the fully closed position. As demonstrated by the arrows, a clockwise (from this perspective) rotation of the hand wheel 110 results in closing of the release door.

The closing of container 200 is accomplished as follows: rotation of the hand wheel 110 in a clockwise direction causes simultaneous rotation of the hand-driven shaft 120 and gear 125; rotation of the hand-driven gear 125 is coupled to rotation of the drive gear 150 and drive shaft 140 via interaction of the meshed gear teeth; rotation of the drive shaft results in rotation of the opener arm 170 downwards and the lever bar 180 towards the opening 195 in the container 200; and the lever bar 180 pushes the release door 190 such that it pivots about attachments 193 and 194 and moves over the opening 195 resulting in the closing of the container 200.

It should be obvious to one of ordinary skill in the art that various components of the present invention including the hand wheel 110, shafts 120 and 140, gears 125 and 150, lever bar 180, opener arm 170 and release door 190 could be arranged in a variety of configurations to provide easy control of a release door 190 used to discharge heavy materials from a container 200. For example, the components could be arranged so that the hand wheel 110 is positioned near the bottom of the container, near the top of the container, or anywhere in between.

What has been described above are preferred embodiments of the present invention. It is, of course, not possible to describe every conceivable combination of methodologies for purposes of describing the present invention. However, one of ordinary skill in the art will recognize that any further combinations, permutations and modifications of the present invention are possible. Therefore, all such possible combinations, permutations and modifications are to be included within the scope of the claimed invention, as defined by the claims below.

What is claimed is:

1. A mechanism for controllably discharging a material from a mobile concrete delivery bucket, said mechanism comprising:

a container having an interior communicating with a container discharge outlet for selectively storing a material or discharging said stored material;

a release door for varying the size of said outlet, said release door carried by said container and rotatable about a first axis of rotation, said release door positioned to adjust the size of said container discharge outlet when rotated about said first axis;

a first shaft carried by said container and rotatable about a second axis of rotation, said second axis of rotation being parallel to and at a distance from said first axis of rotation;

a lever mechanism for coupling the rotational motion of said first shaft to said release door, said lever mechanism including:

an opener arm fixedly connected to said drive shaft; and a lever bar having a first end pivotably connected to said opener arm and a second end pivotably connected to said release door for linking the rotational movement of said first shaft to said release door such that said release door may be moved from a first position to a second position thereby varying the size of said container discharge outlet;

a second shaft carried by said container, said second shaft rotatable about a third axis of rotation parallel to said first and second axes of rotation, said second shaft coupled to said first shaft by a gearing mechanism such that a mechanical advantage is gained; and an actuator for controllably rotating said second shaft, whereby said controlled rotation of said second shaft results in controlled motion of said release door to incrementally adjust the size of said container discharge outlet.

2. The device of claim 1, wherein said actuator includes a wheel.

3. The device of claim 2, wherein the diameter of said wheel is approximately 20–30 inches.

* * * * *